US005203449A

United States Patent [19]

Bonardi

[11] Patent Number: 5,203,449

[45] Date of Patent: Apr. 20, 1993

[54] RAPID DEPLOYMENT APPARATUS

[76] Inventor: G. Fonda Bonardi, 2075 Linda Flora Dr., Los Angeles, Calif. 90077

[21] Appl. No.: 813,485

[22] Filed: Dec. 26, 1991

[51] Int. Cl.[5] ..... B65D 25/28; B65D 55/02

[52] U.S. Cl. ..... 206/1.5; 70/71; 190/118; 206/316.2; 206/317; 220/264; 220/318; 292/8

[58] Field of Search ..... 70/63, 69, 70, 71; 190/106, 118, 119; 206/1.5, 316.1, 316.2, 316.3, 317; 220/264, 318, 335; 292/8, 41, 138, 143, 145, 146, 150

[56] References Cited

U.S. PATENT DOCUMENTS

| | | | |
|---|---|---|---|
| 403,029 | 5/1889 | Barrett | 190/118 |
| 4,119,199 | 10/1978 | Whitaker, Jr. | 206/317 |
| 4,346,924 | 8/1982 | Herriott | 206/1.5 |
| 4,466,537 | 8/1984 | McMahan | 206/317 |
| 4,721,205 | 1/1988 | Burt et al. | 206/317 |
| 4,838,585 | 6/1989 | Jondrow | 292/8 |
| 4,914,931 | 4/1990 | Shu | 70/69 |
| 5,009,088 | 4/1991 | Cislo | 70/63 |
| 5,027,967 | 7/1991 | Tellas | 206/317 |
| 5,048,682 | 9/1991 | Taylor | 206/317 |
| 5,056,342 | 10/1991 | Prinz | 206/317 |

*Primary Examiner*—Jimmy G. Foster
*Attorney, Agent, or Firm*—J. E. Brunton

[57] ABSTRACT

An improved apparatus for transporting a utilitarian object such as a weapon, camera, or the like in a concealed manner which includes a deployment mechanism that can be easily activated to instantly deploy the object for use. The apparatus includes an enclosure which in its normal transport mode has the appearance of an attache case. The utilitarian object is concealed within the attache case until the deployment mechanism is actuated causing the attache case to fall away from the utilitarian object readying it for use. A novel safing mechanism is provided within the handle of the attache case to positively prevent accidental actuation of the deployment mechanism.

14 Claims, 2 Drawing Sheets

FIG. 4
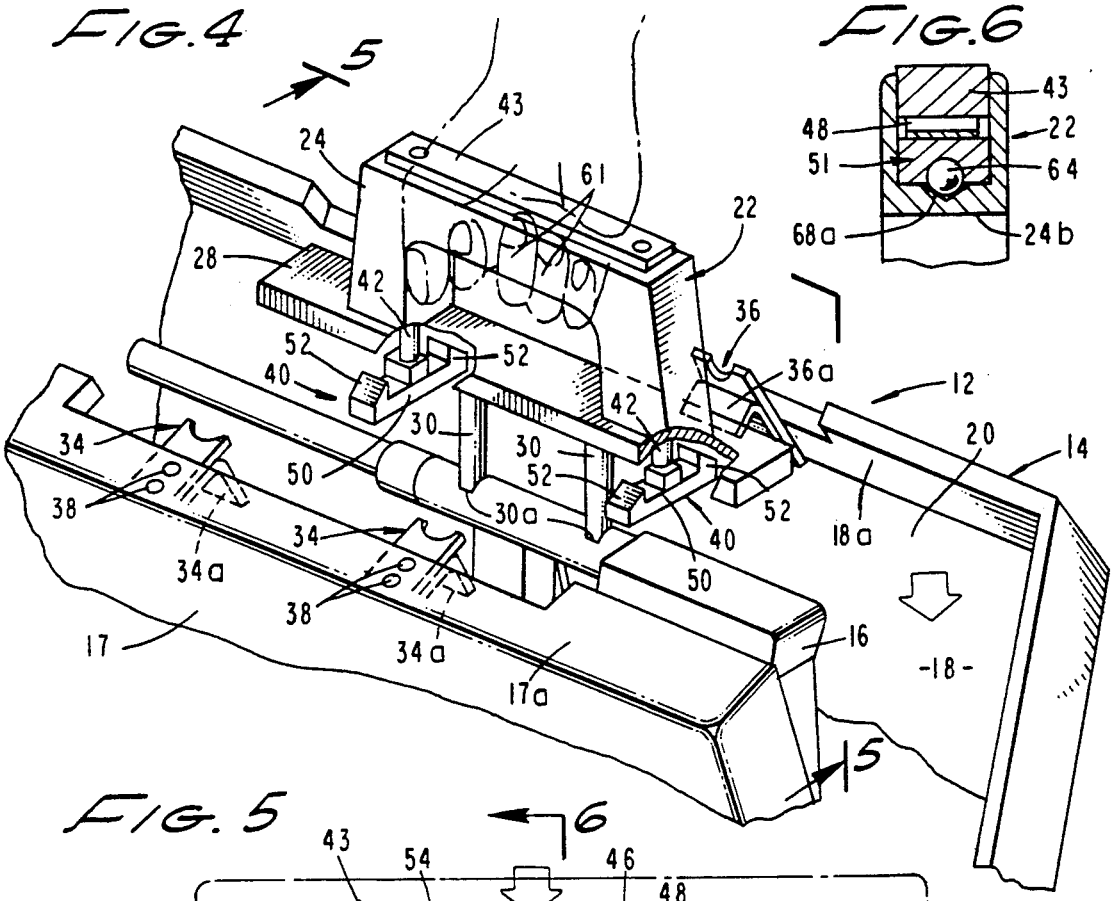
FIG. 6
FIG. 5
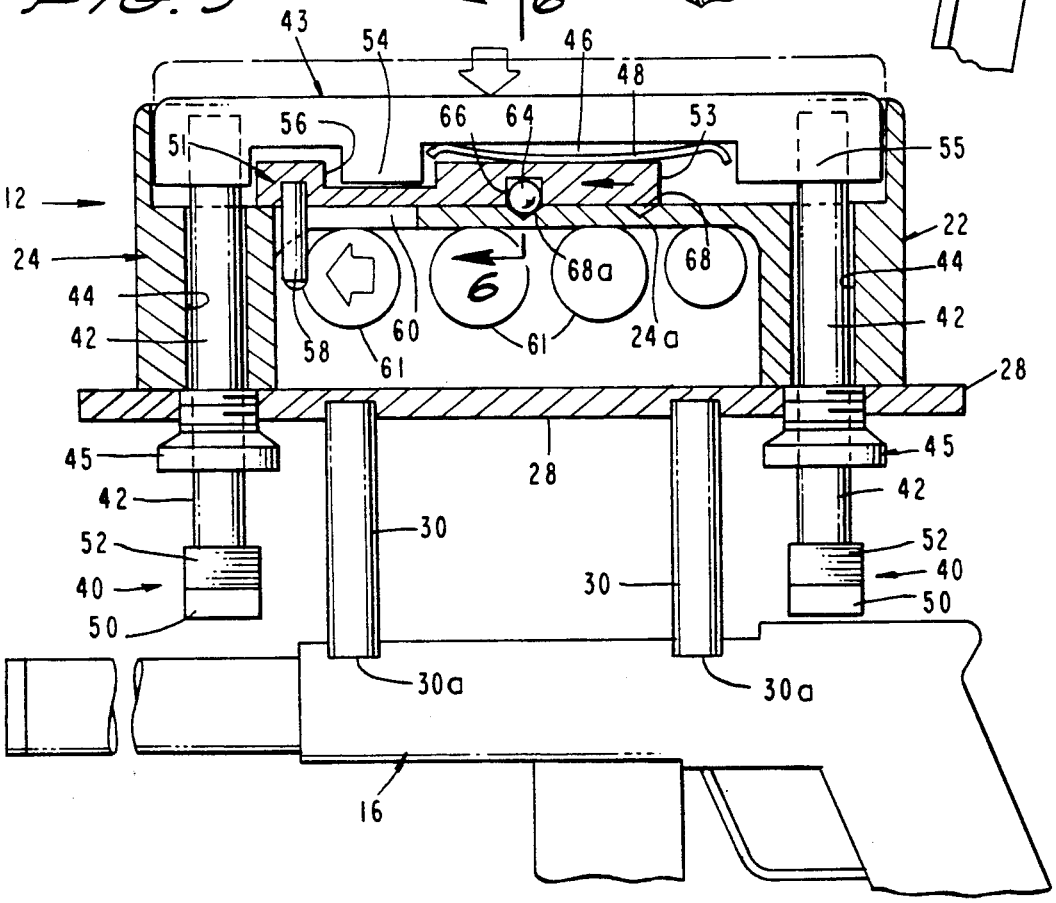

RAPID DEPLOYMENT APPARATUS

BACKGROUND OF THE INVENTION

1. Field of the Invention

The present invention relates generally to apparatus for transporting utilitarian objects such as weapons, cameras, and electronic devices in a concealed manner and then for rapidly deploying the objects for use. More particularly the invention concerns an improved transportable enclosure for concealing the utilitarian objects which includes a novel safing mechanism for preventing accidental deployment of the object.

2. Discussion of the Invention

Law enforcement agencies frequently have a need to transport items such as weapons, cameras, light sources and electronic devices in a concealed manner. In the past, specially designed suitcases and briefcases of various configurations have fulfilled this need. However, such devices are often difficult and time consuming to open in emergency situations. One of the most effective and successful prior art devices for transporting and concealing objects such as weapons and then for easily and rapidly deploying the objects for use is disclosed in U.S. Pat. No. 5,027,967 issued to Tellas. However, the Tellas apparatus does not include safety means for reliably preventionary accidental deployment. The thrust of the present invention is to overcome this shortcoming by providing an enclosure of the general character disclosed by Tellas for carrying a weapon or other article in a concealed manner which includes a novel and highly reliable safing mechanism which effectively prevents accidental and inadvertent deployment of the utilitarian article.

In summary the Tellas apparatus comprises an enclosure that can close around an utilitarian object, and then can be quickly opened so as to fall away from the object. This deployment action occurs when the person carrying the assembled enclosure presses on a release bar located on the handle of the enclosure. It has been proven in practice that the actuating bar on the handle of the Tellas apparatus can be pressed inadvertently by any number of unforeseen circumstances, resulting in the case falling away and exposing the weapon or other article at times and in places where this is not desirable. It is necessary, therefore, to provide the apparatus with a safety device which can be quickly and unobtrusively opened so as to permit immediate actuation of the release mechanism when needed. The outer case itself is generally inconspicuous and devoid of external markings. It can be put down, picked up and passed from one hand to the other many times before a need may arise to deploy the enclosed object. It is important, however that the object such as a weapon be oriented the correct way when the need for its use arises. Therefore the handle of the carrying case must be provided with means for unobtrusively informing the person carrying the briefcase as to the orientation of the object within. Both of the aforesaid requirements are simultaneously fulfilled by the uniquely improved apparatus of the present invention.

SUMMARY OF THE INVENTION

It is an object of the present invention to provide an apparatus for transporting a utilitarian object such as a weapon, câmera, or the like in a concealed manner, which includes a deployment mechanism that can be easily activated to instantly deploy the object for use.

Another object of the invention is to provide an apparatus of the aforementioned character which includes a novel safing mechanism that effectively prevents accidental deployment and inadvertent disclosure of the utilitarian object.

Another object of the invention is to provide an apparatus as described in the preceding paragraph, in which the deployment mechanism and the safing mechanism is concealed within the carrying handle of the transport case.

Another object of the invention is to provide an apparatus of the class described in which the safing mechanism can be expeditiously and unobtrusively moved from the safe or disabling status to the armed or enabling status at the sole option of the person carrying the transport case.

Another object of the invention is to provide an apparatus as described in the preceding paragraph, in which the action required to move the safing mechanism from the safe to the armed condition and or vice-versa can be performed easily, quickly and positively, without looking at the device and without attracting attention to the action being performed.

Still another object of the invention is to provide an apparatus of the character described which automatically insures that a weapon contained in the briefcase is being carried in a proper orientation for immediate use after deployment.

Yet another object of the invention is to provide an apparatus as described in the preceding paragraphs which is compact, light weight, reliable and easy to use in emergency situations.

BRIEF DESCRIPTION OF THE DRAWINGS

FIG. 4 is a generally perspective illustrative view, illustrating the manner in which the carrying case portion of the apparatus moves into an open position;

FIG. 5 is a cross-sectional view taken along lines 5—5 of FIG. 4; and FIG. 6 is a cross-sectional view taken along lines 6—6 of FIG. 5.

DESCRIPTION OF THE INVENTION

Figure 1:
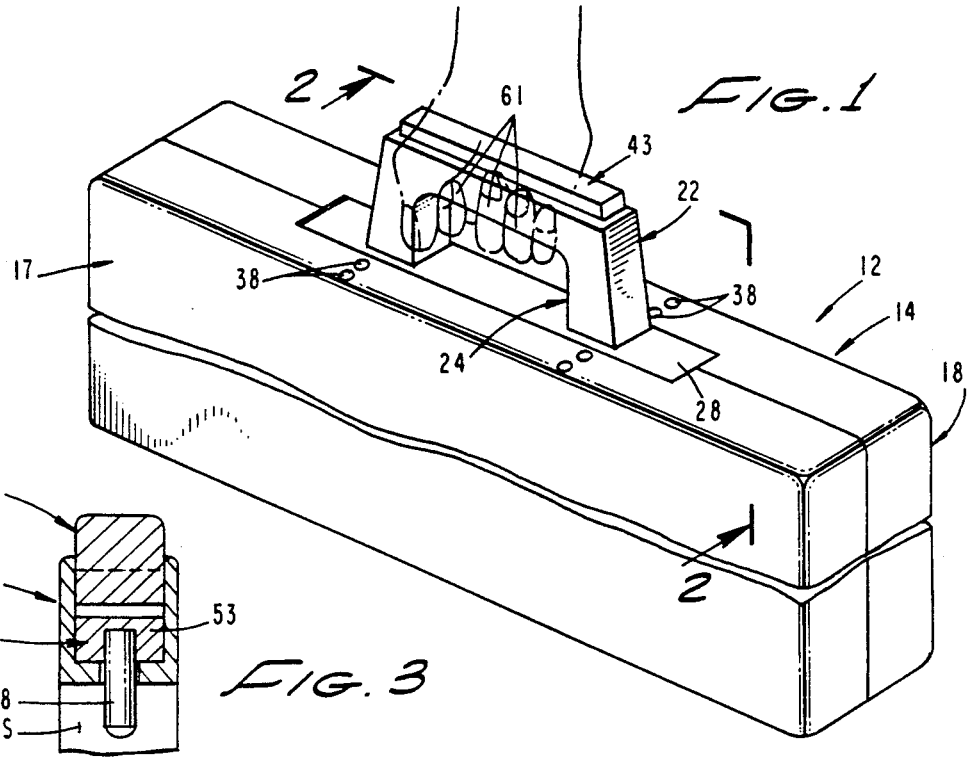
FIG. 1 is a foreshortened, generally perspective view of the apparatus of the invention.
Figure 2:
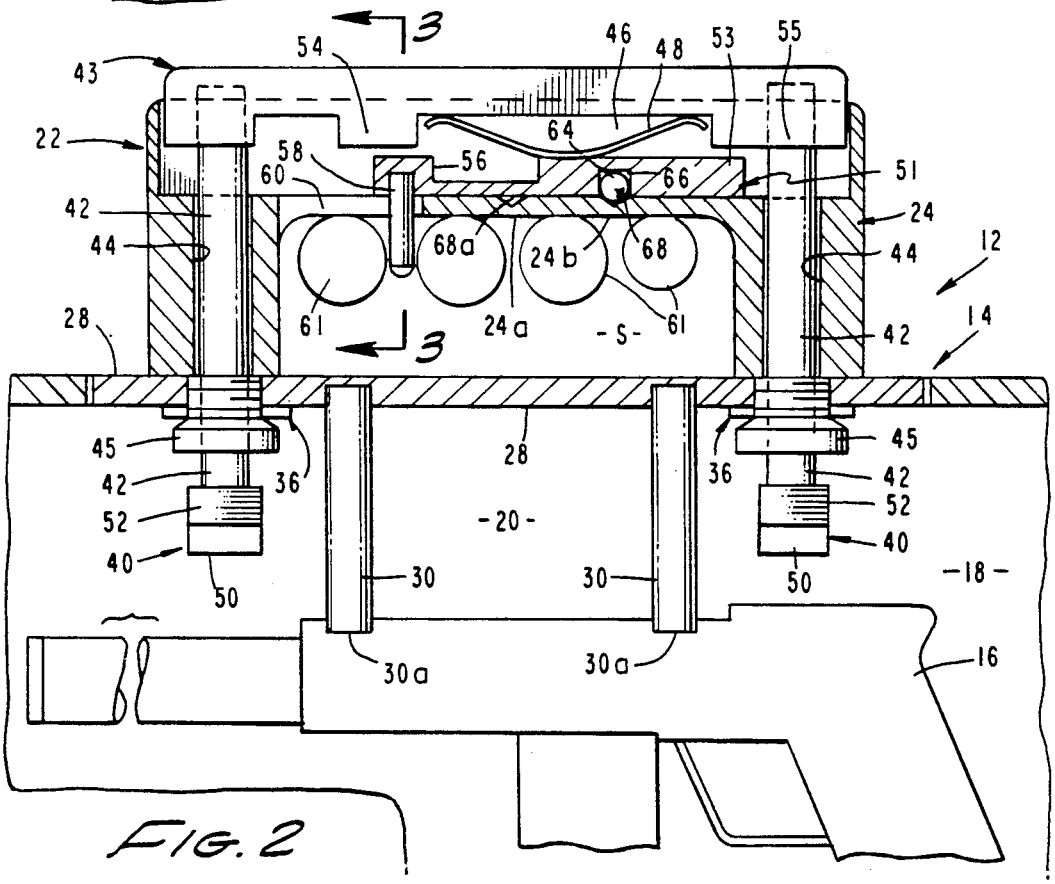
FIG. 2 is a cross-sectional view, taken along lines 2—2 of FIG. 1.

Referring to the drawings and particularly to FIGS. 1, 2, and 4, one form of the improved rapid deployment apparatus of the present invention for concealing and then rapidly deploying for use a utilitarian object such as weapon, camera, electronic device or like object is generally designated by the numeral 12. The apparatus comprises a portable enclosure 14 for enclosing the utilitarian object such as weapon 16 (FIGS. 2 and 4), which enclosure includes first and second hingeably connected portions 17 and 18 movable from a first closed position, shown in FIG. 1, to a second open position shown in FIG. 4. Portions 17 and 18 are interconnected by a bottom hinge assembly of conventional construction (not shown). When the enclosure 14 is in its first position, first and second portions 17 and 18 cooperate to define an internal chamber 20 for concealing the object 16. As illustrated in FIG. 4, when enclosure 14 is in the second open position, the enclosure is free to fall away from the object 16 making it immediately available for use.

To releasably secure first and second pOrtions 17 and 18 of enclosure 14 in the first position shown in FIG. 1, securement means of unique construction are provided. Operably associated with the securement means are deployment means for causing the first and second portions of the enclosure 14 to rapidly move from the closed position to the open position shown in FIG. 4. These securement and deployment means are described in detail in the Tellas U.S. Pat. No. 5,027,967.

As can be seen by referring to FIG. 4, the deployment means of the present form of the invention includes means for carrying enclosure 14, shown here as a handle assembly 22. Handle assembly 22 comprises a U-shaped gripping handle 24 which is affixed by suitable fasteners to a generally planer shaped base member 28. Forming a part of handle assembly 22 is adapter means for interconnection with the utilitarian object 16. In the form of the invention shown in the drawings, the adapter means comprise a pair of downwardly depending support rods 30 which are connected at their upper ends to a plate 28 by any appropriate means. Utilitarian object 16 is interconnected in an appropriate fashion as by welding or brazing with support members 30 proximate their lower ends 30*a*.

Referring particularly to FIG. 4, the securement of the present embodiment of the invention comprises a pair of longitudinally spaced-apart first latohing elements 34 connected to an upper wall 17*a* of first enclosure portion 17 and a second pair longitudinally of spaced-apart latching elements 36 connected to an upper wall 18*a* of second enclosure portion 18. Each of the latching elements 34 and 36 include a first generally horizontally extending portion which is interconnected with walls 17*a* and 18*a* by suitable fasteners such as rivets 38 and a second downwardly depending portion designated in the drawings by the numerals 34*a* and 36*a* respectively. Also comprising a portion of the securement means is a pair of third latching elements 40 connected proximate the lower ends of a pair of cylindrically shaped connector members 42 which form a part of handle assembly 22. Mounted proximate the upper ends of members 42 is an actuating bar 43, the purpose of which will presently be described.

Connector members 42 are telescopically movable within bores 44 provided in handle 24 from a first raised position shown in FIG. 2 to a second depressed position shown in FIG. 5. Carried within a cavity 46 provided in the upper portion of handle 24 is a leaf spring 48, which functions to yieldably maintain actuating bar 43 in the first raised position shown in FIG. 2. Guide plugs 45 are threadably receivable within base 28 to guide telescopic movement of connector members 42 within bores 44. (FIG. 2).

As best seen in FIG. 4, each of the third latching elements 40 comprises a horizontally extending base portion 50 having upwardly extending, transversely spaced, hook-like portions 52 provided at either end. With this construction, when actuating bar 43 is held in its normal upward position as shown in FIGS. 1, 2, and 4, hook-like elements 52 of the third latching elements 40 engage downwardly depending portions 34*a* and 36*a* of first latching elements 34 and 36 so as to hold enclosure 14 in the closed position illustrated in FIG. 1. However, a downward force exerted against actuating bar 43 against the urging of leaf spring 46 will cause the third latching elements 40 to move downwardly within container 14 into the position shown in FIG. 4. In this position, hook-like end portions 52 will clear downwardly depending portions 34*a* and 36*a* of the first and second latching elements enabling the biasing means of the invention to move the first and second portions into the open position shown in FIG. 4. As the enclosure moves to the open position it will fall downwardly away from handle 24 by force of gravity thereby exposing article 16 for use.

An important aspect of the present invention is the provision of safing means, shown here as safing mechanism 50 which is mounted within handle 24 and functions to prevent accidental deployment of article 16 as a result of separation of portions 17 and 18 of container 14.

The safing means of the invention here comprises a uniquely configured slider bar 52 which, in a first position, limits the downward movement of actuating bar 43. Actuating bar 43 is also of unique construction having on its lower surface a downwardly extending protuberances 54 and 55 which are located intermediate the extremities of the actuating bar. Slider bar 52, on the other hand, is provided with a recess 56 which is of a size to closely receive protuberance 54 when slider bar 52 is moved from the first position shown in FIG. 2 to the second position shown in FIG. 5. It is to be noted that when the slider bar is in the first position, protuberances 54 and 55 block depression of actuating bar 43. However, when the slider bar is in the second position the actuating bar can be depressed fully by exertion of a force sufficient to overcome the urging of leaf spring 48.

Figure 3:
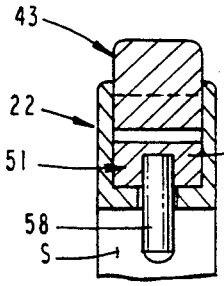
FIG. 3 is a cross-sectional view, taken along lines 3—3 of FIG. 2.

Slider bar 52 is slidably moved within handle 24 from the first to the second position by finger engaging means here provided as a downwardly protruding finger engageable pin 58 which is carried by slider bar 52 proximate its forward end, pin 58 extends through a slot 60 provided in the bottom surface 24 of a handle 24 (FIG. 3) and into the space "S" normally occupied by the fingers 61 of the person carrying the apparatus. With this construction, pin 58 can be expeditiously and unobtrusively engaged by the person carrying the case.

To prevent inadvertent arming of the safing mechanism, locking means for preventing accidental sliding of the slider bar is provided. The locking means here comprises a detent, shown without loss of generality in the form of a ball 64 carried in a recess 66 formed in the bottom surface of the slider bar (FIG. 6). Detent, or ball 64 is constructed and arranged so that leaf spring 48 will normally urge the ball into a selected one of two longitudinally spaced dimples 68 and 68*a* formed in bottom wall 24*b* of the handle.

While carrying and using the apparatus of the invention, handle 24 is gripped so that pin 58 is positioned between the users first and second fingers in the manner shown in FIG. 2. With pin 58 in this location, the safing mechanism is in the safe position blocking depression of the actuating bar and the weapon 16 is pointing in the correct direction. If the carrying case happened to be turned the wrong way, pin 58 would fall between the users third and fourth fingers immediately alerting the operator that the case was being improperly carried. This would be true whether the operator is right or left handed or whether the case is carried in the users right or left hand. To arm the device the user exerts a forward pressure on pin 58 with sufficient force to cause ball 64 to roll out of dimple 68. The slider bar then slids freely into the second position shown in FIG. 5 where ball 64 engages dimple 68*a*. The apparatus is now in the armed condition with protuberance 54 of the actuating bar being aligned with recess 56 of the slider bar. As the slider bar moves into the armed position a barely audible click is perceived as the ball drops into the forward dimple. This gives the user a positive signal that the slider bar is in the correct position to arm the apparatus. The detent action also prevents accidental arming or disarming of the apparatus as a result of external factors such as vibration, shocks or the like.

With the slider bar in the armed position, a downward force on the actuating bar against the urging of spring 46 will cause the latching elements 40 to move downwardly within the enclosure. Hook like end portions 52 will then clear deploying portions 34*a* and 36*a* enabling the opening biasing means to separate first and second portions 17 and 18 thereby exposing weapon 16 for immediate use. For the details of construction of the case opening biasing means and for a more complete description of the case opening operation, reference should be made to U.S. Pat. No. 5,027,967 the specification of which is hereby incorporated herein by reference.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departure from the scope and spirit of the invention, as set forth in the following claims.

I claim:

1. An improved rapid deployment apparatus for concealing and then rapidly deploying for use a utilitarian object, said apparatus being of a character having an enclosure for enclosing the utilitarian object, including operably associated first and second portions movable between a first position defining an internal chamber for concealing the object and a second position deploying the object for use, said enclosure having a hollow handle; securement means interconnected with said enclosure for releasably maintaining said first and second portions thereof in said first position; and deployment means operably associated with said securement means for interaction with said securement means upon actuation of said deployment means to move said first and second portions of said enclosure from said first closed to said second open position; the improvement comprising safing means for preventing accidental actuation of the deployment means, said safing means comprising:

(a) a slider bar disposed within said hollow handle, said slider bar being movable from a first position blocking actuation of said deployment means to a second position permitting actuation of said deployment means; and (b) finger engaging means for moving said slider bar from said first to said second position, said finger engaging means comprising a downwardly extending member connected to said slider bar.

2. An improved apparatus as defined in claim 1 further including locking means for yieldably resisting movement of said slider bar from said first position to said second position.

3. An improved apparatus as defined in claim 2 in which said hollow handle includes a base member having spaced apart dimples formed therein, and in which said locking means includes a detent carried by said slider bar and partially receivable within said dimples.

4. An improved apparatus as defined in claim 3 further including means for yieldably resisting movement of said detent out of said dimples.

5. A rapid deployment apparatus for concealing and then exposing an utilitarian object, comprising:

(a) an enclosure for enclosing the utilitarian object, including:

(i) a first portion;

(ii) a second portion hingeably connected to said first position, said first and second portions being movable between a first position defining an internal chamber for concealing the utilitarian object and a second portion exposing the utilitarian object; and (iii) a hollow handle connected to one of said first and second portions, said handle having a cavity;

(b) securement means connected to said enclosure for maintaining said first and second portions thereof in said first position;

(c) deployment means connected to said enclosure and operably associated with said securement means for interaction with said securement means upon actuation of said deployment means to permit said first and second portions of said enclosure to move toward said second position, and said deployment means comprising an actuating bar mounted within said cavity of said handle for movement between a first normal position and a second actuation position, and (d) safety means for preventing accidental actuation of said deployment means, said safety means comprising:

(i) a slider bar disposed within said cavity of said handle, said slider bar being movable from a first position blocking actuation of said deployment means to a second position permitting actuation of said deployment means; and (ii) finger engaging means for moving said slider bar from said first to said second position, said finger engaging means comprising a downwardly extending pin connected to said slider bar.

6. An improved apparatus as defined in claim 5 in which said actuating bar is provided with at least one downwardly extending protuberance and in which said slider bar is provided with at lease one recess for receiving said protuberance when said slider bar is in said second position.

7. An improved apparatus as defined in claim 6 further including locking means for yieldably resisting movement of said slider bar from said first position to said second position.

8. The improved apparatus as defined in claim 7 in which said handle includes a base member having spaced apart dimples formed therein, and in which said locking means includes a ball carried by said slider bar and partially receivable within said dimples.

9. An improved rapid deployment apparatus for concealing and then exposing an utilitarian object, comprising:

(a) an enclosure for enclosing the utilitarian object, including:

(i) a first portion, (ii) a second portion hingeably connected to said first portion, said first and second portions being movable between a first position defining an internal chamber for concealing the utilitarian object and a second position exposing the utilitarian object; and (iii) a handle connected to one of said first and second portions, said handle having a cavity;

(b) securement means connected to said enclosure for maintaining said first and second portions thereof in said first position; and (c) deployment means connected to said enclosure and operably associated with said securement means for interaction with said securement means to permit said first and second portions of said enclosure to move toward said second position, and said deployment means including:

(i) an actuating bar mounted within said cavity of said handle for movement between a first normal position and a second actuation position, said actuating bar having a downwardly extending protuberance; and (ii) biasing means for yieldably resisting movement of said actuating bar toward said second actuating position;

(d) Safety means for preventing accidental actuation of said deployment means, said safety means comprising:

(i) a slider bar disposed within said cavity of said handle, said slider bar having access for receiving said protuberances of said actuating bar and being movable from a first position blocking actuation of said deployment means to a second position permitting actuation of said deployment means; and (ii) finger engaging means for moving said slider bar from said first to said second position, said finger engaging means comprising a downwardly extending pin connected to said slider bar.

10. An improved apparatus as defined in claim 9 further including biasing means mounted within said enclosure for continuously urging said first and second portions to move toward said second position.

11. An improved apparatus as defined in claim 10 in which said securement means comprises a first latching element connected to said first portion of said enclosure and a second latching element connected to said second portion of said enclosure.

12. An improved apparatus as defined in claim 11, further including a connecter member telescopically movable within said handle and a third latching element connected to said connector member for releasably interconnecting said first and second latching elements.

13. An improved apparatus as defined in claim 12 further including locking means for yieldably resisting movement of said slider bar from said first position to said second position.

14. An improved apparatus as defined in claim 13 in which said hollow handle includes a base member having spaced apart dimples formed therein , and in which said locking means includes a ball carried by said slider bar and partially receivable within said dimples.

* * * * *